US005499171A

United States Patent [19]

Simpson et al.

[11] Patent Number: 5,499,171

[45] Date of Patent: Mar. 12, 1996

[54] DOOR LOCK ILLUMINATION APPARATUS

[76] Inventors: Dixie L. Simpson; Mike Simpson, both of 909 S. 29th, Muskogee, Okla. 74401

[21] Appl. No.: 502,937

[22] Filed: Jul. 17, 1995

[51] Int. Cl.[6] ..... E05B 17/10

[52] U.S. Cl. ..... 362/100; 362/145; 362/802

[58] Field of Search ..... 362/100, 145, 362/155, 276, 802

[56] References Cited

U.S. PATENT DOCUMENTS

| | | | |
|---|---|---|---|
| 500,026 | 6/1893 | Morey | 362/100 |
| 2,562,687 | 7/1951 | Anderson | 362/100 |
| 2,813,195 | 11/1957 | Willey et al. | 362/100 |
| 4,533,985 | 8/1985 | Jasinski | 362/276 |
| 4,779,171 | 10/1988 | Ferguson | 362/100 |
| 4,872,095 | 10/1989 | Dubak et al. | 362/100 |

*Primary Examiner*—Stephen F. Husar

[57] ABSTRACT

A door lock illumination apparatus is provided for illuminating a door lock assembly carried by a dwelling door which is adjacent to a dwelling door frame and which is in close proximity to a storm door and to an AC power source. The door lock illumination apparatus includes a storm-door-responsive switch assembly mounted on a portion of the dwelling door frame. An AC-powered illumination source is mounted on a portion of the dwelling door frame in proximity to the door lock assembly. A first conductor assembly is connected between the AC-powered illumination source and the storm-door-responsive switch assembly. A second conductor assembly is connected between the storm-door-responsive switch assembly and the AC power source, and a third conductor assembly is connected between the AC-powered illumination source and the AC power source. The storm-door-responsive switch assembly includes a normally closed switch. A storm-door-contacting switch actuator contacts the storm door when the storm door is closed. The normally closed switch remains open when the storm door is in contact with the storm-door-contacting switch actuator, and the normally closed switch closes when the storm door is removed from contact with the storm-door-contacting switch actuator.

2 Claims, 2 Drawing Sheets

DOOR LOCK ILLUMINATION APPARATUS

BACKGROUND OF THE INVENTION

1. Field of the Invention

The present invention relates generally to illumination devices and, more particularly, to illumination devices especially adapted to illuminate a keyhole on a door lock.

2. Description of the Prior Art

It is well known that, at night, it is often difficult for a person to see a keyhole in a door lock to insert a key therein. This can pose a safety problem because, in certain localities, it may be unsafe to stand at a locked door and struggle with finding the keyhole. Throughout the years, a number of innovations have been developed relating to illuminating keyholes in door locks, and the following U.S. patents are representative of some of those innovations: U.S. Pat. Nos. 500,026, 2,813,195, 4,533,985, 4,779,171, and 4,872,095. More specifically, U.S. Pat. No. 500,026 discloses an electric lamp for illuminating a keyhole in a door lock wherein the electric lamp is activated by a manually-operated switch. Often a person has one's hands full when one is trying to unlock and open a door. In this respect, one may not readily have a free hand available for manually operating a switch. Therefore, it would be desirable if a keyhole illuminator for a door did not use a manually-operated switch.

Each of U.S. Pat. Nos. 2,813,195 and 4,872,095 discloses a keyhole illuminator for a door lock wherein the source of illumination is located on one side of a door, and the keyhole of the door lock is located at a considerable distance from the source of illumination. Such a distance may be a limiting factor in the amount of light that actually reaches the keyhole and that successfully illuminates the keyhole. In this respect, it would be desirable if a keyhole illuminator for a door had a source of illumination located very close to the keyhole which is being illuminated.

It is noted that a significantly beneficial feature of each of U.S. Pat. Nos. 2,813,195 and 4,872,095 is that each source of illumination is activated by the act of opening of a storm door. Generally, a storm door is not locked and is located outside of the main door of the dwelling which is locked. Generally, one can readily open the storm door without the need of a key and without the need of additional illumination. Thus, it is very desirable for a keyhole illuminator for a door to be automatically activated when the storm door is opened.

Each of U.S. Pat. Nos. 2,813,195, 4,779,171, and 4,872,095 discloses a battery-powered keyhole illuminator for a door lock. Battery-powered illuminators have a number of disadvantages. As the battery power is consumed, the power output gradually decreases, and the amount of illumination provided decreases. In cold weather, batteries provide less power than in warm weather. Worn batteries must be replaced. The battery power source, if exposed to outside weather elements, must be water proof. In this respect, it would be desirable if a keyhole illuminator for a door lock did not depend upon battery power as its power source.

U.S. Pat. No. 4,533,985 discloses a keyhole illuminator that employs an illumination device that swings out from a housing. For purposes of simplicity and convenience, it would be desirable if a keyhole illuminator for a door employs a stationary source of illumination.

Still other features would be desirable in a door lock illumination apparatus. More specifically, the front door areas of dwellings usually have AC-powered porch lights or landing lights. In this respect, it would be desirable if a keyhole illuminator for a door could be powered by the same AC power source that powers the porch lights or landing lights.

Presently, most keyholes for door locks are not provided with a door lock illumination apparatus. In this respect, it would be desirable if a keyhole illuminator for a door could be provided that is readily retrofitted to present door structures.

Thus, while the foregoing body of prior art indicates it to be well known to use door lock illumination devices, the prior art described above does not teach or suggest a door lock illumination apparatus which has the following combination of desirable features: (1) does not use a manually-operated switch; (2) does not depend upon battery power as its power source; (3) has a source of illumination located very close to the keyhole which is being illuminated; (4) is automatically activated when a storm door is opened; (5) employs a stationary source of illumination; (6) is powered by the same AC power source that powers porch lights or landing lights; and (7) can be readily retrofitted to present door structures. The foregoing desired characteristics are provided by the unique door lock illumination apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a door lock illumination apparatus for illuminating a door lock assembly carried by a dwelling door which is adjacent to a dwelling door frame and which is in close proximity to a storm door and to an AC power source. The door lock illumination apparatus includes a storm-door-responsive switch assembly mounted on a portion of the dwelling door frame. An AC-powered illumination source is mounted on a portion of the dwelling door frame in proximity to the door lock assembly. A first conductor assembly is connected between the AC-powered illumination source and the storm-door-responsive switch assembly. A second conductor assembly is connected between the storm-door-responsive switch assembly and the AC power source, and a third conductor assembly is connected between the AC-powered illumination source and the AC power source.

The storm-door-responsive switch assembly includes a normally closed switch. A storm-door-contacting switch actuator contacts the storm door when the storm door is closed. The normally closed switch remains open when the storm door is in contact with the storm-door-contacting switch actuator, and the normally closed switch closes when the storm door is removed from contact with the storm-door-contacting switch actuator.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved door lock illumination apparatus which has all of the advantages of the prior art and none of the disadvantages.

It is another object of the present invention to provide a new and improved door lock illumination apparatus which may be easily and efficiently manufactured and marketed.

It is a further object of the present invention to provide a new and improved door lock illumination apparatus which is of durable and reliable construction.

An even further object of the present invention is to provide a new and improved door lock illumination apparatus which is susceptible of a low cost of manufacture with regard to both materials and labor, and which accordingly is then susceptible of low prices of sale to the consuming public, thereby making such door lock illumination apparatus available to the buying public.

Still yet a further object of the present invention is to provide a new and improved door lock illumination apparatus which does not use a manually-operated switch.

Still another object of the present invention is to provide a new and improved door lock illumination apparatus that does not depend upon battery power as its power source.

Yet another object of the present invention is to provide a new and improved door lock illumination apparatus which has a source of illumination located very close to the keyhole which is being illuminated.

Even another object of the present invention is to provide a new and improved door lock illumination apparatus that is automatically activated when a storm door is opened.

Still a further object of the present invention is to provide a new and improved door lock illumination apparatus which employs a stationary source of illumination.

Yet another object of the present invention is to provide a new and improved door lock illumination apparatus that is powered by the same AC power source that powers porch lights or landing lights.

Still another object of the present invention is to provide a new and improved door lock illumination apparatus which can be readily retrofitted to present door structures.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
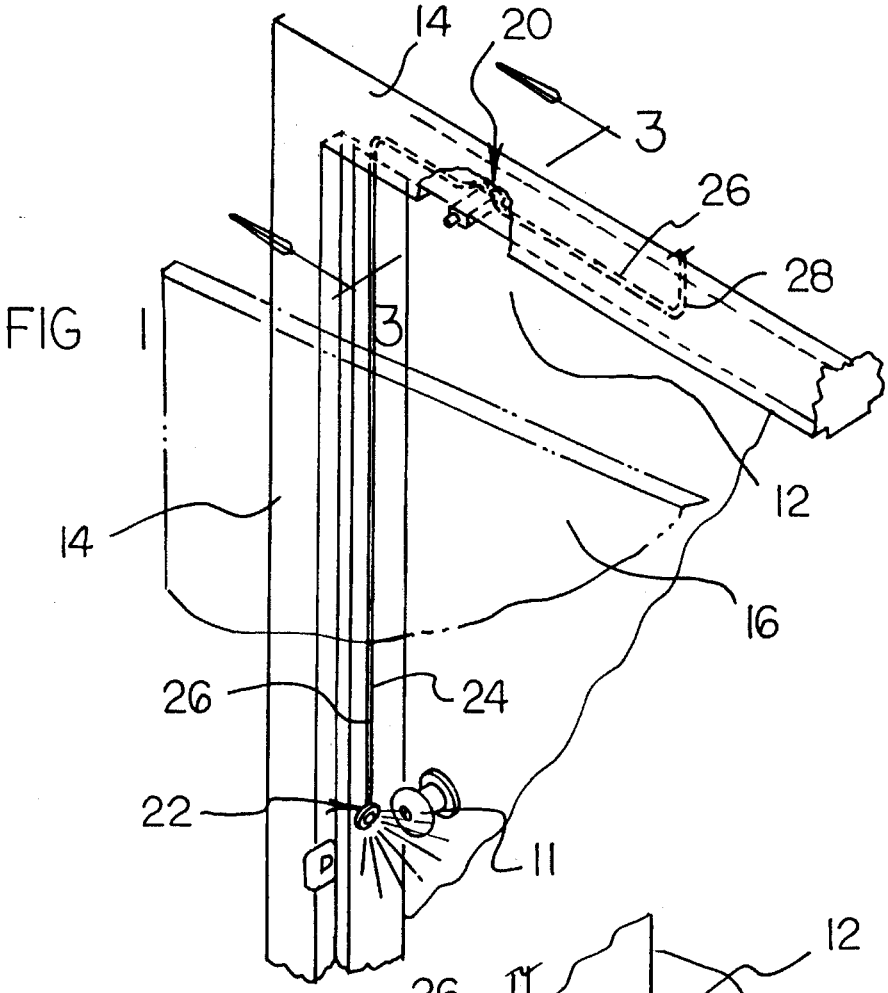
FIG. 1 is a perspective view showing a preferred embodiment of the door lock illumination apparatus of the invention installed in a door frame of a dwelling.
Figure 2:
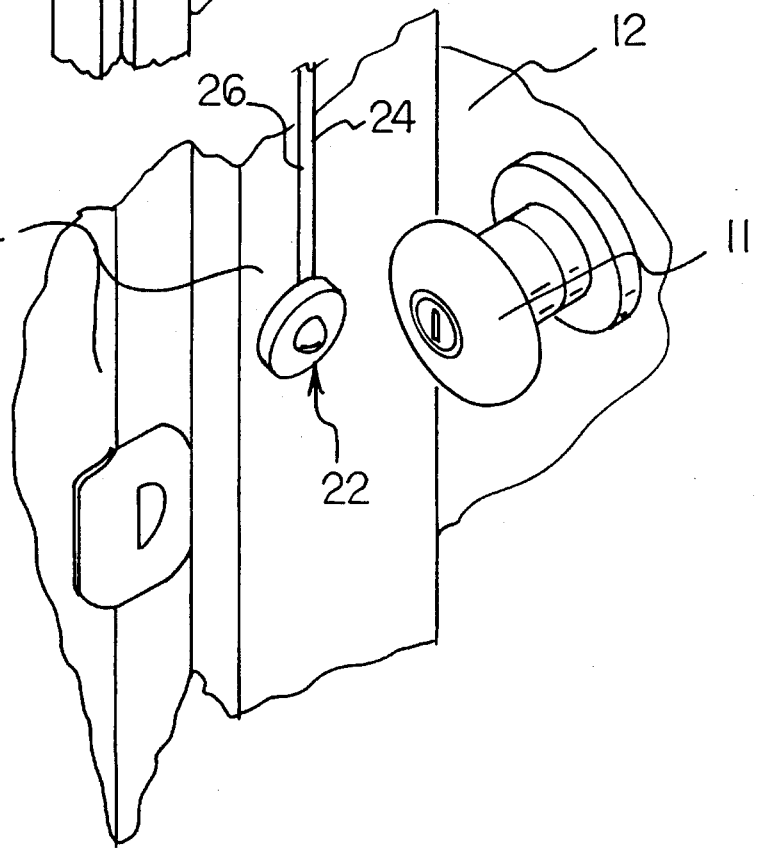
FIG. 2 is an enlarged perspective view of a keyhole-illuminating portion of the embodiment of the door lock illumination apparatus shown in FIG. 1.

With reference to the drawings, a new and improved door lock illumination apparatus embodying the principles and concepts of the present invention will be described.

Turning to FIGS. 1–4, there is shown an exemplary embodiment of the door lock illumination apparatus of the invention generally designated by reference numeral 10. In its preferred form, door lock illumination apparatus 10 is provided for illuminating a door lock assembly 11 carried by a dwelling door 12 which is adjacent to a dwelling door frame 14 and which is in close proximity to a storm door 16 and to an AC power source 18. The door lock illumination apparatus 10 includes a storm-door-responsive switch assembly 20 mounted on a portion of the dwelling door frame 14. An AC-powered illumination source 22 is mounted on a portion of the dwelling door frame 14 in proximity to the door lock assembly 11. A first conductor assembly 24 is connected between the AC-powered illumination source 22 and the storm-door-responsive switch assembly 20. A second conductor assembly 26 is connected between the storm-door-responsive switch assembly 20 and the AC power source 18, and a third conductor assembly 28 is connected between the AC-powered illumination source 22 and the AC power source 18.

The storm-door-responsive switch assembly 20 includes a normally closed switch 21. A storm-door-contacting switch actuator 23 contacts the storm door 16 when the storm door 16 is closed. The normally closed switch 21 remains open when the storm door 16 is in contact with the storm-door-contacting switch actuator 23, and the normally closed switch 21 closes when the storm door 16 is removed from contact with the storm-door-contacting switch actuator 23.

In using the door lock illumination apparatus 10 of the invention, the storm-door-responsive switch assembly 20 is installed in a top portion of the dwelling door frame 14. The storm-door-responsive switch assembly 20 is installed so that the storm-door-contacting switch actuator 23 projects toward the storm door 16. The AC-powered illumination source 22 is installed on a side portion of the dwelling door frame 14 adjacent to the door lock assembly 11 when the dwelling door 12 is in a closed position. The first conductor assembly 24 is connected to the one post of the normally closed switch 21 of the storm-door-responsive switch assembly 20. The second conductor assembly 26 is connected directly to the AC power source 18. The third conductor assembly 28 is connected from a second post of the normally closed switch 21 to the AC power source 18.

When the storm door 16 is closed, the storm door 16 pushes against the storm-door-contacting switch actuator 23 in the storm-door-responsive switch assembly 20. The storm-door-contacting switch actuator 23 controls whether the normally closed switch 21 is either open or closed. When the storm door 16 is closed, the storm door 16 overcomes the bias of spring 25 which urges the normally closed switch 21 toward the closed position. Therefore, when the storm door 16 is closed, the normally closed switch 21 is in an open position. Therefore, when the storm door 16 is closed, the AC-powered illumination source 22 is off.

Figure 3:
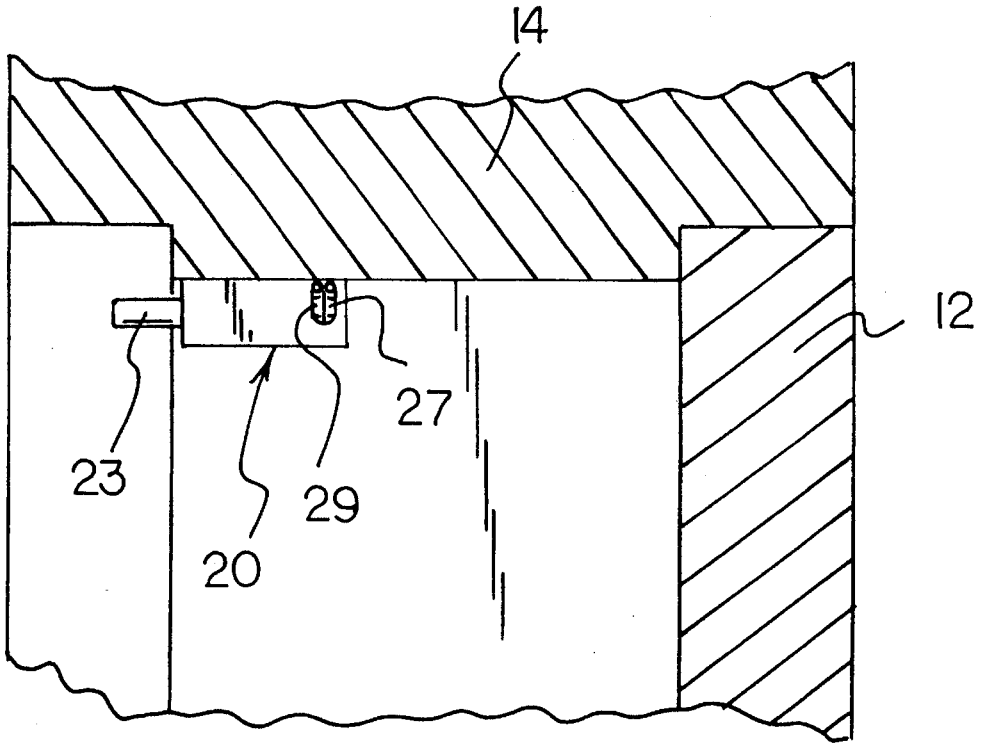
FIG. 3 is an enlarged cross-sectional view of a storm-door activated switch portion of embodiment of the door lock illumination apparatus of FIG. 1 taken along line 3—3 of FIG. 1.
Figure 4:
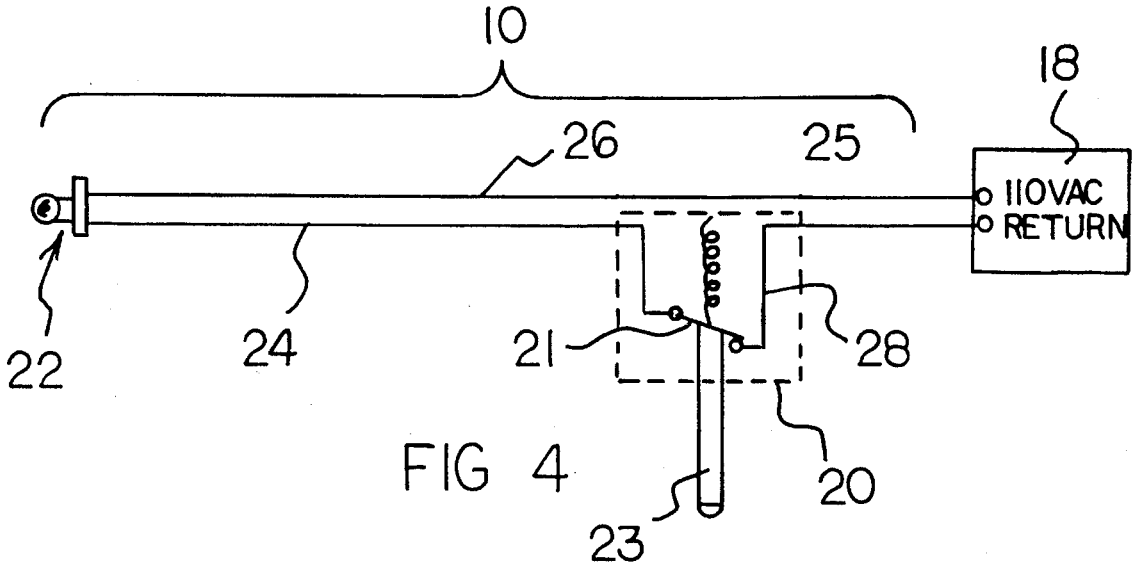
FIG. 4 is an electrical schematic diagram of the door lock illumination apparatus of the invention.

However, when the storm door 16 is opened, the storm door 16 no longer contacts the storm-door-contacting switch actuator 23. As a result, the spring 25 in the storm-door-responsive switch assembly 20 is able to urge the normally closed switch 21 to its normally closed position, as shown in FIGS. 1, 3, and 4. When this happens the AC-powered illumination source 22 is activated, and illumination is shined onto the door lock assembly 11 in the dwelling door 12. Thus, when the storm door 16 is opened, the door lock assembly 11 is automatically illuminated by the AC-powered illumination source 22.

Generally, an AC-powered porch light or landing light is provided for outside a dwelling door 12. In this respect, the AC power source 18 for the porch light or landing light can be tapped into to serve as the AC power source 18 for the door lock illumination apparatus 10 of the invention. This facilitates retrofitting of conventional doors with the door lock illumination apparatus 10 of the invention.

It is noted that the first conductor assembly 24 and the second conductor assembly 26 can be in the form of a two-wire cable. Similarly, the second conductor assembly 26 and the third conductor assembly 28 can be in the form of a two-wire cable. As shown in FIG. 3, posts 27 and 29 can be used to connect the storm-door-responsive switch assembly 20 to the conductors 24 and 28, respectively.

The components of the door lock illumination apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved door lock illumination apparatus that is low in cost, relatively simple in design and operation, and which may advantageously be used without employing a manually-operated switch. With the invention, a door lock illumination apparatus is provided which does not depend upon battery power as its power source. With the invention, a door lock illumination apparatus is provided which has a source of illumination located very close to the keyhole which is being illuminated. With the invention, a door lock illumination apparatus is provided which is automatically activated when a storm door is opened. With the invention, a door lock illumination apparatus is provided which employs a stationary source of illumination. With the invention, a door lock illumination apparatus is provided which is powered by the same AC power source that powers porch lights or landing lights. With the invention, a door lock illumination apparatus is provided which can be readily retrofitted to present door structures.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A door lock illumination apparatus for illuminating a door lock assembly carried by a dwelling door which is adjacent to a dwelling door frame and which is in close proximity to a storm door and to an AC power source, comprising:

a storm-door-responsive switch assembly mounted on a portion of the dwelling door frame, an AC-powered illumination source mounted on a portion of the dwelling door frame in proximity to the door lock assembly, a first conductor assembly connected between said AC-powered illumination source and said storm-door-responsive switch assembly, a second conductor assembly connected between said storm-door-responsive switch assembly and the AC power source, and a third conductor assembly connected between said AC-powered illumination source and the AC power source.

2. The apparatus of claim 1 wherein said storm-door-responsive switch assembly includes:

a normally closed switch, and a storm-door-contacting switch actuator contacts the storm door when the storm door is closed, wherein said normally closed switch remains open when the storm door is in contact with said storm-door-contacting switch actuator, and wherein said normally closed switch closes when the storm door is removed from contact with said storm-door-contacting switch actuator.

* * * * *